US008515649B2

(12) United States Patent
Takagi et al.

(10) Patent No.: US 8,515,649 B2
(45) Date of Patent: Aug. 20, 2013

(54) FUEL INJECTION DEVICE FOR INTERNAL COMBUSTION ENGINE

(75) Inventors: Noboru Takagi, Toyota (JP); Hiromitsu Seo, Toyota (JP); Eiichiro Kido, Nagoya (JP); Takamitsu Mizutani, Toyota (JP); Hirokazu Ando, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/508,678

(22) PCT Filed: May 25, 2010

(86) PCT No.: PCT/JP2010/058822

§ 371 (c)(1),
(2), (4) Date: May 8, 2012

(87) PCT Pub. No.: WO2011/148462

PCT Pub. Date: Dec. 1, 2011

(65) Prior Publication Data

US 2013/0096804 A1 Apr. 18, 2013

(51) Int. Cl.
*F02D 41/30* (2006.01)

(52) U.S. Cl.
USPC ..... 701/104; 123/435; 123/431

(58) Field of Classification Search
USPC ..... 701/103–105; 123/435, 431, 299, 123/300, 578
See application file for complete search history.

(56) References Cited

U.S. PATENT DOCUMENTS 6,223,121 B1 4/2001 Ishida et al.
6,340,014 B1 * 1/2002 Tomita et al. ..... 123/295
7,213,574 B2 * 5/2007 Nishimura ..... 123/431
7,249,454 B2 * 7/2007 Ichise et al. ..... 60/285
7,269,941 B2 * 9/2007 Ichise et al. ..... 60/284
7,302,928 B2 * 12/2007 Satou et al. ..... 123/295
7,412,821 B2 * 8/2008 Araki et al. ..... 60/284
2006/0207241 A1 9/2006 Araki et al.

FOREIGN PATENT DOCUMENTS

JP A-11-223145 8/1999
JP A-11-223146 8/1999
JP A-2006-063947 3/2006
JP A-2006-177193 7/2006
JP A-2006-226151 8/2006
JP A-2006-258007 9/2006
JP A-2008-038678 2/2008

OTHER PUBLICATIONS

International Search Report issued in Application No. PCT/JP2010/058822; Dated Jun. 22, 2010 (With Translation).

* cited by examiner

*Primary Examiner* — Hai Huynh
(74) *Attorney, Agent, or Firm* — Oliff & Berridge, PLC

(57) ABSTRACT

The present invention is directed to fuel injection devices for internal combustion engines. An object of the present invention is to provide a fuel injection device for an internal combustion engine capable of identifying a non-contributing fuel quantity when port injection and cylinder injection are simultaneously performed. If an explosion count and a coolant temperature for any cycle can be acquired, they can be applied to a first map and a second map to thereby find non-contributing fuel for 100% port injection and non-contributing fuel for 100% cylinder injection, respectively. Each of these found values of the non-contributing fuel is multiplied by a corresponding injection share ratio during injection of the non-contributing fuel to thereby find non-contributing fuel that takes into account the injection share ratio. Finally, these values are added up to arrive at a non-contributing fuel requirement value.

8 Claims, 8 Drawing Sheets

FUEL INJECTION DEVICE FOR INTERNAL COMBUSTION ENGINE

TECHNICAL FIELD

The present invention relates to fuel injection devices for internal combustion engines. More specifically, the invention relates to an injection device for what-is-called a dual injection type internal combustion engine including a port injector for injecting fuel into an intake port of the internal combustion engine and a cylinder injector for injecting fuel directly into a cylinder of the internal combustion engine.

BACKGROUND ART

A known injection device intended for a dual injection type internal combustion engine includes a port injector for injecting fuel into an intake port of the internal combustion engine and a cylinder injector for injecting fuel directly into a cylinder. In the injection device for the dual injection type internal combustion engine, either one or both of the port injector and the cylinder injector can be selectively used according to an operating condition of the internal combustion engine. Fuel efficiency and output characteristics can therefore be improved by changing an injection share ratio between injection from the port injector (hereinafter also referred to as "port injection") and injection from the cylinder injector (hereinafter also referred to as "cylinder injection") according to the operating condition of the internal combustion engine.

Patent document 1, for example, discloses a fuel injection device of this kind that performs port injection after the engine is started and performs both port injection and cylinder injection simultaneously thereafter. After the engine is started, fuel atomization by cylinder injection may not be promoted because of possible insufficient development of fuel pressure supplied to the cylinder injector. This may cause a deposit of fuel on a cylinder wall. In this fuel injection device, therefore, only the port injection is performed after the engine is started until fuel atomization by the cylinder injection is enabled.

The above-described fuel injection device also estimates an amount of fuel deposited in an intake port up to that point when starting the cylinder injection. The amount of fuel deposited in the intake port is estimated because, after the engine is started, fuel through the port injection may not be atomized due to insufficient warm-up. This can cause the deposit of fuel in the intake port, and the amount of fuel actually burned is possible to be smaller than the amount of port-injected fuel.

CITATION LIST

Patent Documents

Patent Document 1: JP-A-2006-226151
Patent Document 2: JP-A-11-223145
Patent Document 3: JP-A-11-223146

SUMMARY OF THE INVENTION

Problem to be Solved by the Invention

In the above-referenced patent document, the fuel deposited in the intake port vaporizes as the engine warms up, and flows into a combustion chamber to thereby contribute to combustion. Therefore, to achieve an even more accurate fuel injection control, desirably the amount of fuel vaporized as well as the amount of fuel deposited in the intake port is estimated.

Incidentally, an injected fuel contains fuel not contributing to combustion at all (hereinafter also referred to as "non-contributing fuel") that is different from the fuel described above that contributes to combustion. Cases in which the injected fuel turns into non-contributing fuel includes, but not limited to, (i) liquid fuel is deposited on a cylinder bore and is not vaporized at low temperatures to be scraped off by a piston ring and cleared off into a crankcase; (ii) liquid-phase combustion causes the liquid fuel to be heated and decomposed without being in contact with oxygen and exhausted in carbon fowl; and (iii) liquid fuel is directly exhausted as is.

Consideration of the non-contributing fuel allows a shortage of a fuel injection quantity to be compensated for, so that an even more accurate fuel injection control can be achieved. Unfortunately, however, none of documents including above-referenced patent document 1 focus on the non-contributing fuel.

The present invention has been made to solve the above-mentioned problem and it is an object of the present invention to provide a fuel injection device for an internal combustion engine capable of identifying a non-contributing fuel quantity when both port injection and cylinder injection are simultaneously performed.

Means for Solving the Problem

To achieve the above mentioned purpose, a first aspect of the present invention is a fuel injection device for an internal combustion engine comprising:

a port injector for injecting fuel into an intake port of the internal combustion engine;

a cylinder injector for directly injecting fuel into a cylinder of the internal combustion engine; means for calculating, for each cycle, a fuel injection quantity required for achieving a target air-fuel ratio;

means for setting, for each cycle, an injection share ratio of fuel to be shared between the port injector and the cylinder injector;

means for acquiring a predetermined parameter associated with a temperature of the internal combustion engine;

a model for associating a ratio of non-contributing fuel, of fuel injected during one cycle, not contributing to combustion with a predetermined parameter associated with the temperature of the internal combustion engine and the injection share ratio of fuel to be shared between the port injector and the cylinder injector; and means for selecting the relationship map that corresponds to the set injection share ratio, calculating the ratio of the non-contributing fuel by applying the selected relationship map to the predetermined parameter, and calculating a quantity of the non-contributing fuel by applying the fuel injection quantity to the calculated non-contributing fuel.

A second aspect of the present invention is the fuel injection device for an internal combustion engine according to the first aspect, wherein:

the model comprises:

a first map for establishing, when fuel is injected only from the port injector, a relation between a ratio of non-contributing fuel, of fuel injected during one cycle, not contributing to combustion and a first parameter associated with the temperature of the internal combustion engine;

a second map for establishing, when fuel is injected only from the cylinder injector, a relation between a ratio of non-contributing fuel, of fuel injected during one cycle, not contributing to combustion and a second parameter associated with the temperature of the internal combustion engine;

means for calculating a first non-contributing ratio as a ratio of non-contributing fuel derived from the port injector by applying the first parameter to the first map to thereby calculate a ratio of non-contributing fuel, and multiplying the ratio of non-contributing fuel thus calculated by the injection share ratio;

means for calculating a second non-contributing ratio as a ratio of non-contributing fuel derived from the cylinder injector by applying the second parameter to the second map to thereby calculate a ratio of non-contributing fuel, and multiplying the ratio of non-contributing fuel thus calculated by (1−the injection share ratio); and means for adding the first non-contributing ratio and the second non-contributing ratio.

A third aspect of the present invention is the fuel injection device for an internal combustion engine according to the second aspect, wherein:

the predetermined parameter used for the first map includes an explosion count of the internal combustion engine.

A forth aspect of the present invention is the fuel injection device for an internal combustion engine according to the second aspect, wherein:

the predetermined parameter used for the second map includes a coolant temperature of the internal combustion engine.

Effects of the Invention

In the first aspect of the present invention, the injection share ratio of fuel and the predetermined parameter associated with the temperature of the internal combustion engine can be applied to the model. The model associates the ratio of non-contributing fuel with the above-described predetermined parameter and the injection share ratio of fuel. The ratio of non-contributing fuel can therefore be found by applying the injection share ratio of fuel and the predetermined parameter to the model. Then, a quantity of the non-contributing fuel can be found by applying the found ratio of non-contributing fuel to the above-described fuel injection quantity. The quantity of the non-contributing fuel can therefore be easily calculated according to the injection share ratio of fuel and the predetermined parameter.

The map allows the first non-contributing ratio to be calculated by applying the first parameter to the first map and further going through multiplication by the injection share ratio. The second non-contributing ratio can also be calculated by applying the second parameter to the second map and further going through multiplication by (1−the injection share ratio). The first non-contributing ratio and the second non-contributing ratio can also be added up. By adding the first non-contributing ratio and the second non-contributing ratio, the ratio of non-contributing fuel of the total injection quantity can be calculated. As such, in the second aspect of the present invention, the ratio of non-contributing fuel when port injection and cylinder injection are performed simultaneously can be easily calculated.

In the third aspect of the present invention, the predetermined parameter used for the first map includes the explosion count of the internal combustion engine. The explosion count of the internal combustion engine is correlated with a temperature of an intake valve and the temperature of the intake valve is correlated with a temperature of the intake port. Use of the explosion count of the internal combustion engine therefore allows the ratio of non-contributing fuel to be accurately found.

In the fourth aspect of the present invention, the predetermined parameter used for the second map includes the coolant temperature of the internal combustion engine. The coolant temperature of the internal combustion engine is correlated with a temperature in a cylinder. Use of the coolant temperature of the internal combustion engine therefore allows the ratio of non-contributing fuel to be accurately found.

DESCRIPTION OF REFERENCE NUMERALS

Figure 1:
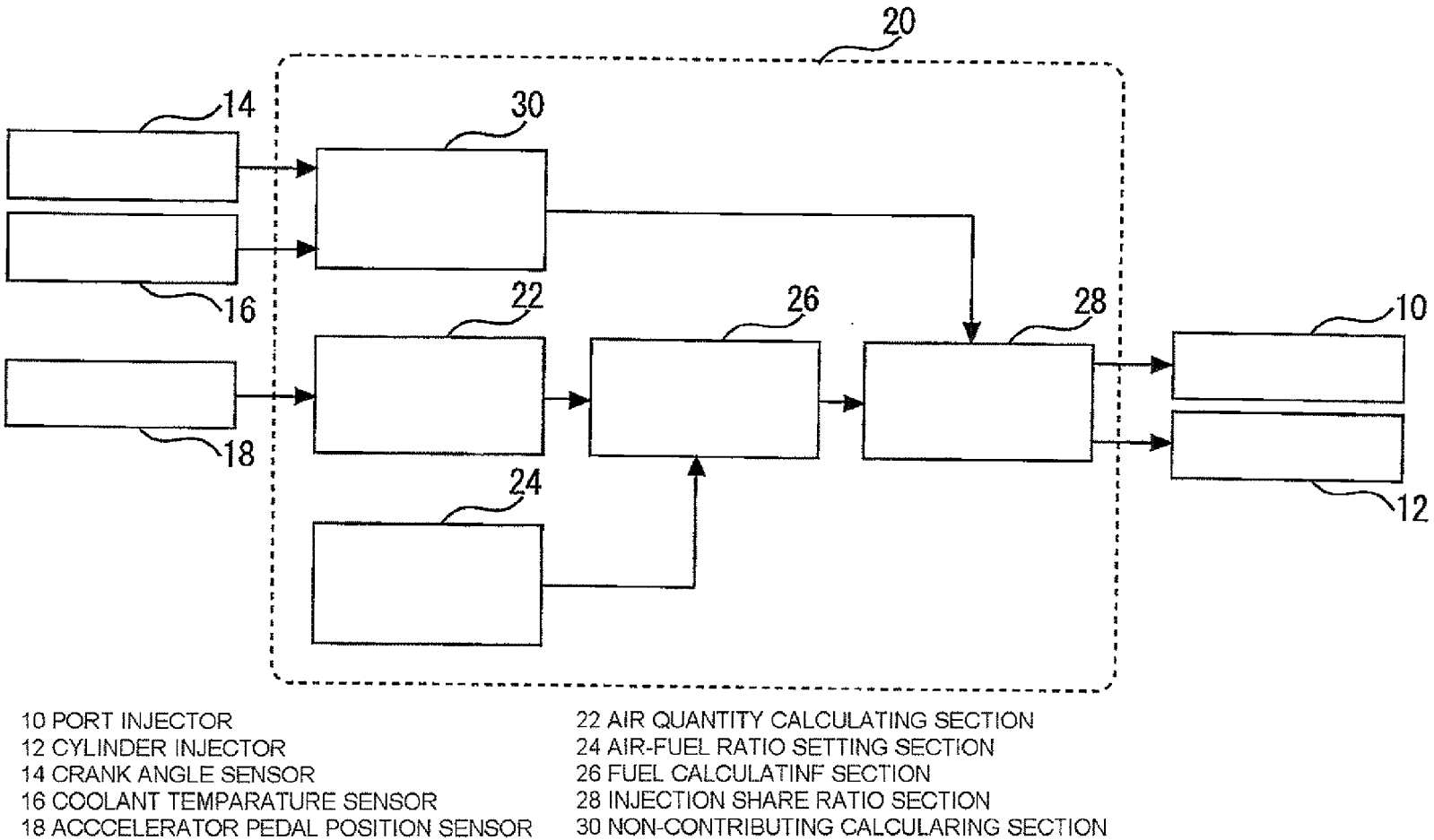
FIG. 1 is a block diagram showing arrangements of a fuel injection device for an internal combustion engine according to an embodiment of the present invention.

10 port injector
12 cylinder injector
14 crank angle sensor
16 coolant temperature sensor
18 accelerator pedal position sensor
20 ECU

BEST MODE FOR CARRYING OUT THE INVENTION

An embodiment of the present invention will be described below with reference to each of FIGS. 1 through 8.

FIG. 1 is a block diagram showing arrangements of a fuel injection device for an internal combustion engine according to an embodiment of the present invention. The fuel injection device of this embodiment is intended to be mounted on a vehicle, for use in what-is-called a dual injection type internal combustion engine that sets a target exhaust air-fuel ratio (hereinafter also referred to as a "target air-fuel ratio") and performs port injection and/or cylinder injection of such a fuel quantity as to achieve the target air-fuel ratio.

The fuel injection device of this embodiment includes a port injector 10, installed in an intake path of the internal combustion engine, for injecting fuel into the intake path (intake port). The fuel infection device of this embodiment also includes a cylinder injector 12 that directly injects fuel into each cylinder of the internal combustion engine. The port injector 10 and the cylinder injector 12 are electrically connected to an output side of an electronic control unit (ECU) 20 and controlled individually by an output signal from the ECU 20.

A crank angle sensor 14 that outputs a signal in synchronism with rotation of a crankshaft of the internal combustion engine is connected to an input side of the ECU 20. The ECU 20 can detect an engine speed NE based on an output from the crank angle sensor 14. In addition, a coolant temperature sensor 16 that outputs a signal according to a coolant temperature of the internal combustion engine and an accelerator pedal position sensor 18 that outputs an accelerator pedal position signal are connected to the input side of the ECU 20.

The fuel injection device of this embodiment further includes an air quantity calculating section 22, an air-fuel ratio setting section 24, a fuel calculating section 26, an injection share ratio setting section 28, and a non-contributing fuel calculating section 30, all disposed within the ECU 20.

An accelerator pedal position signal from the accelerator pedal position sensor 18 is input to the air quantity calculating section 22 of the ECU 20. The accelerator pedal position signal represents an accelerator operation performed by a driver and includes a torque requirement from the driver. The air quantity calculating section 22 sets a target torque that satisfies the torque requirement and translates the target torque to a corresponding target air quantity.

The air-fuel ratio setting section 24 of the ECU 20 sets a target air-fuel ratio. The air-fuel ratio, though variable according to requirements of various sorts placed on the internal combustion engine, is generally set to a stoichiometric ratio (=14.7). The fuel calculating section 26 of the ECU 20 calculates a fuel quantity required for achieving the target air-fuel ratio (hereinafter also referred to as a "fuel quantity requirement") using the target air quantity obtained from the air quantity calculating section 22 and the target air-fuel ratio obtained from the air-fuel ratio setting section 24. For example, if the target air-fuel ratio is set to the stoichiometric ratio, the fuel calculating section 26 finds a value of the target air quantity divided by 14.7 as the fuel quantity requirement.

The fuel quantity requirement calculated by the fuel calculating section 26 is input to the injection share ratio setting section 28 of the ECU 20. The injection share ratio setting section 28 stores therein a well-known model or map. For example, the injection share ratio setting section 28 sets an injection share ratio of fuel to be injected from the port injector 10 and the cylinder injector 12 (hereinafter also referred to simply as an "injection share ratio") according to an operating condition of the internal combustion engine (engine speed and load).

As descried earlier, the injected fuel the contains non-contributing fuel. If the non-contributing fuel is contained, the fuel quantity actually contributing to combustion during one cycle (an intake stroke, a compression stroke, a power stroke, and an exhaust stroke) of the internal combustion engine becomes smaller than the above-mentioned fuel quantity requirement. Accordingly, if the non-contributing fuel is contained, the exhaust air-fuel ratio becomes fuel-leaner than the target air-fuel ratio.

In this embodiment, therefore, the non-contributing fuel calculating section 30 of the ECU 20 calculates a correction value for the non-contributing fuel (hereinafter also referred to as a "non-contributing fuel requirement value"). Output values from the crank angle sensor 14 and the coolant temperature sensor 16 are input to the non-contributing fuel calculating section 30. The non-contributing fuel calculating section 30 calculates the non-contributing fuel requirement value using these input values and first and second maps stored therein. Then, the non-contributing fuel calculating section 30 inputs the non-contributing fuel requirement value thus calculated into the injection share ratio setting section 28. This allows port injection and cylinder injection to be performed with a correction for the non-contributing fuel added to the fuel quantity requirement.

(First Map)

Figure 2:
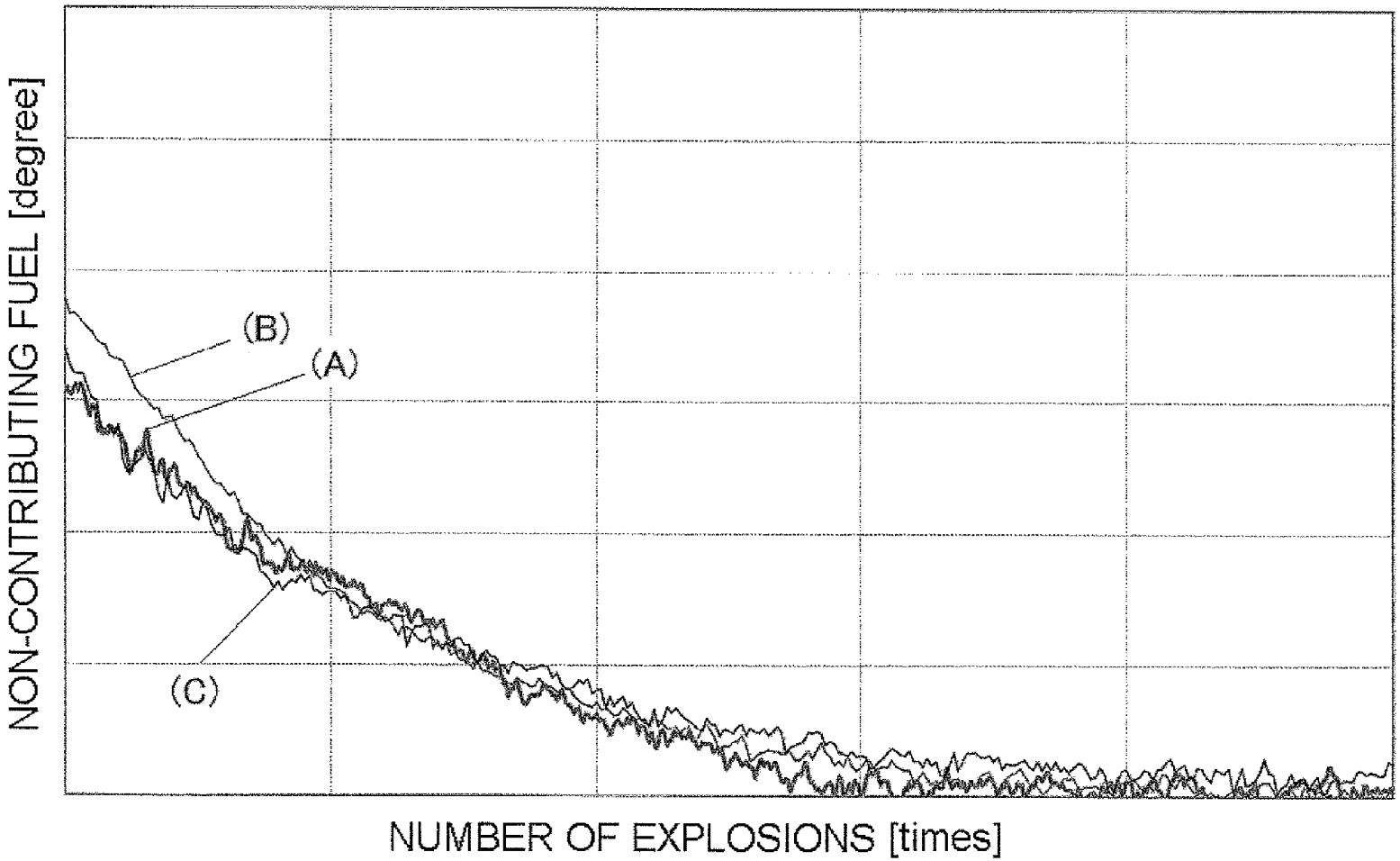
FIG. 2 is a graph showing a relation between the number of explosions of the internal combustion engine [times] and the non-contributing fuel [degree] with varying engine speeds NE and loads KL for 100% port injection.

The first and second maps stored in the non-contributing fuel calculating section 30 will be described. First, the first map will be described. FIG. 2 is a graph showing a relation between the number of explosions of the internal combustion engine [times] and the non-contributing fuel [degree] with varying engine speeds NE and loads KL for 100% port injection.

The above-mentioned relationship graph is prepared by acquiring the non-contributing fuel when the engine speed is varied from zero to a predetermined speed ne with the load set at a constant value kl. In FIG. 2, an integrated value of engine speeds from zero to the predetermined speed ne is used as the number of explosions. Further, in FIG. 2, the non-contributing fuel shows degrees relative to a reference value (=1.0) of the fuel quantity when none of the injected fuel contributes to combustion. Specifically, if half of the injected fuel burns, the non-contributing fuel is 0.5 and, if all of the injected fuel burns, the non-contributing fuel is 0.

Referring to FIG. 2, (A) shows a case of (ne, kl)=(1200, 40), (B) shows a case of (ne, kl)=(2400, 20), and (C) shows a case of (ne, kl)=(2400, 40). As shown in FIG. 2, changes in the non-contributing fuel with respect to changing numbers of explosions are substantially equivalent among (A), (B), and (C). This reveals that there is no big difference produced in the relation between the number of explosions and the non-contributing fuel even with changes in the engine speed NE and the load KL.

Figure 3:
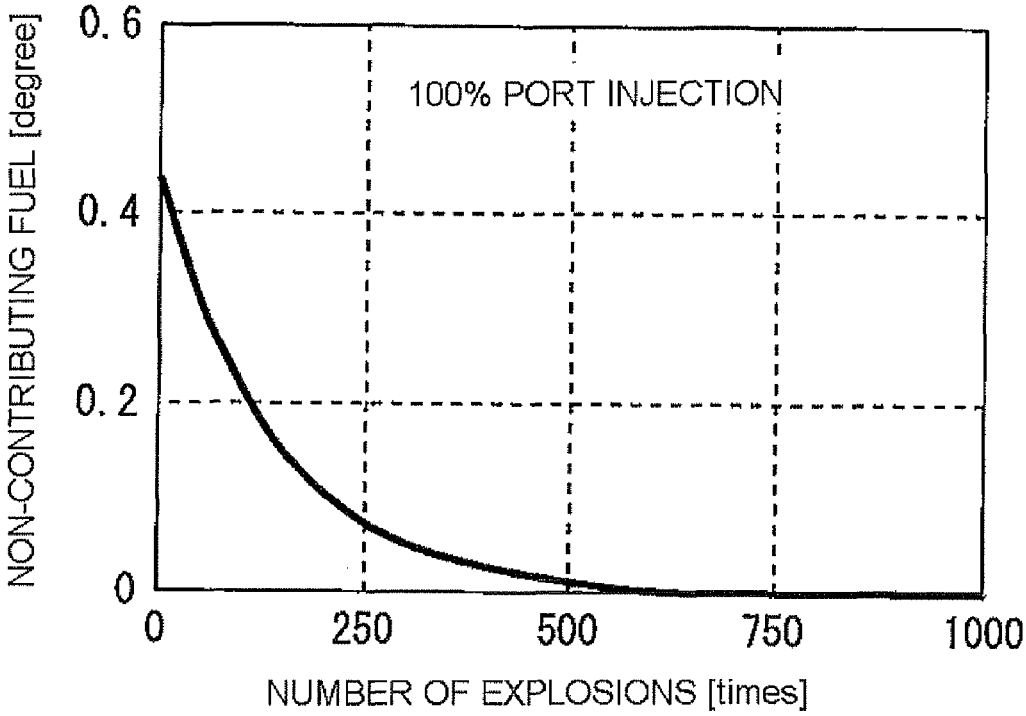
FIG. 3 is the first map of the present invention.

From the foregoing, the relation between the number of explosions of the internal combustion engine and the non-contributing fuel for 100% port injection can be represented by a characteristic curve shown in FIG. 3. This is for the following reason. Specifically, whether the fuel deposited in the intake port turns to the non-contributing fuel is correlated with a temperature in the intake port. The temperature in the intake port is correlated with a temperature of an intake valve. Further, the temperature of the intake valve is correlated with the number of explosions of the internal combustion engine. The number of explosions of the internal combustion engine and the non-contributing fuel are correlated with each other and thus can be represented by one characteristic curve, regardless of the operating condition of the internal combustion engine. In the present invention, the characteristic curve of FIG. 3 is defined as the first map.

(Second Map)

Figure 4:
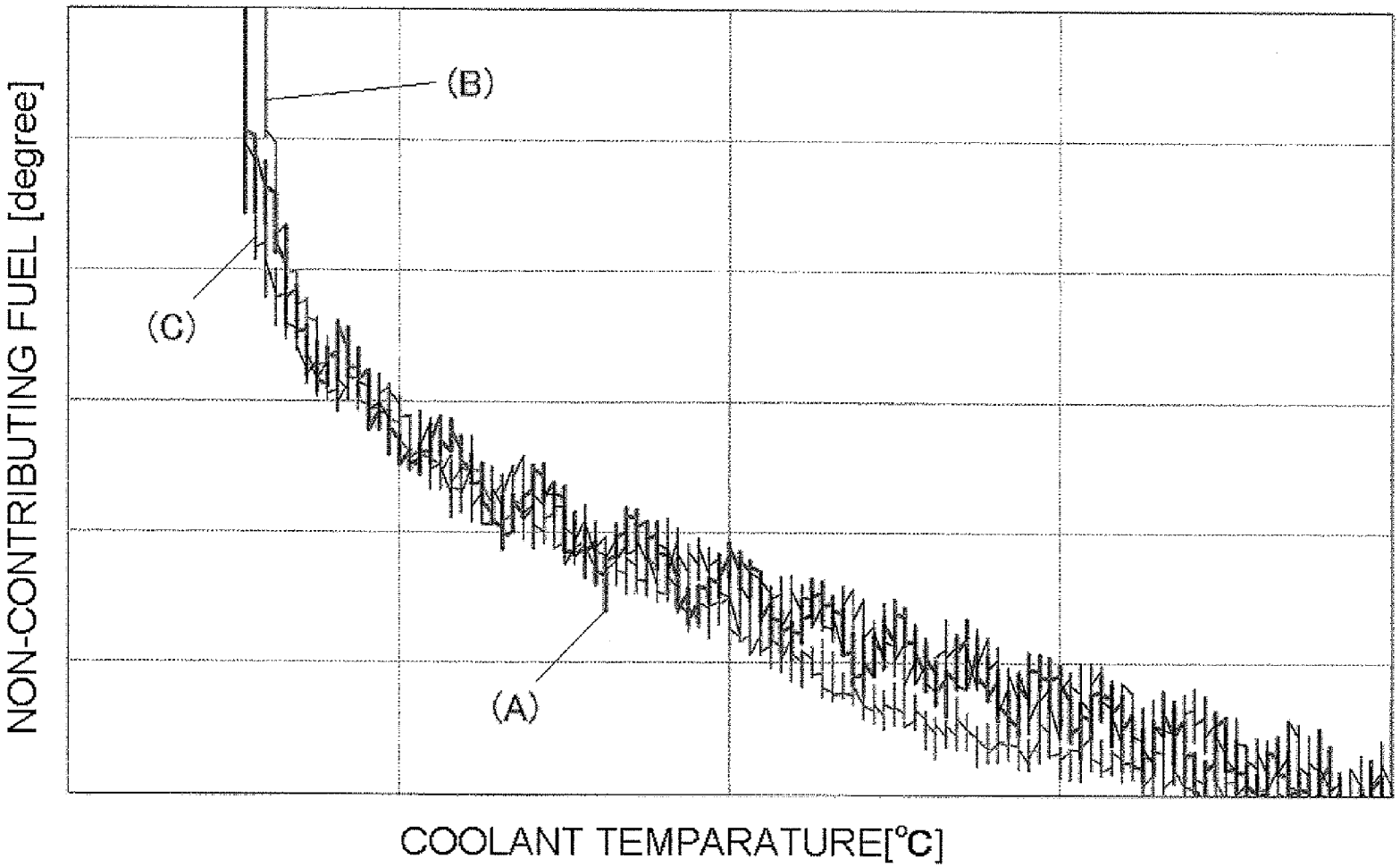
FIG. 4 is a graph showing a relation between the coolant temperature of the internal combustion engine [° C.] and the non-contributing fuel [degree] with varying engine speeds NE and loads KL for 100% cylinder injection.

The second map will be described. FIG. 4 is a graph showing a relation between the coolant temperature of the internal combustion engine [° C.] and the non-contributing fuel [degree] with varying engine speeds NE and loads KL for 100% cylinder injection. This relationship graph is prepared, as with FIG. 2, by acquiring the non-contributing fuel when the engine speed is varied from zero to a predetermined speed ne with the load set at a constant value kl.

Referring to FIG. 4, (A) shows a case of (ne, kl)=(1200, 40), (B) shows a case of (ne, kl)=(2400, 20), and (C) shows a case of (ne, kl)=(2400, 40). As shown in FIG. 4, changes in the non-contributing fuel with respect to changing coolant temperatures are substantially equivalent among (A), (B), and (C). This reveals that there is no big difference produced in the relation between the coolant temperature and the non-contributing fuel even with changes in the engine speed NE and the load KL.

Figure 5:
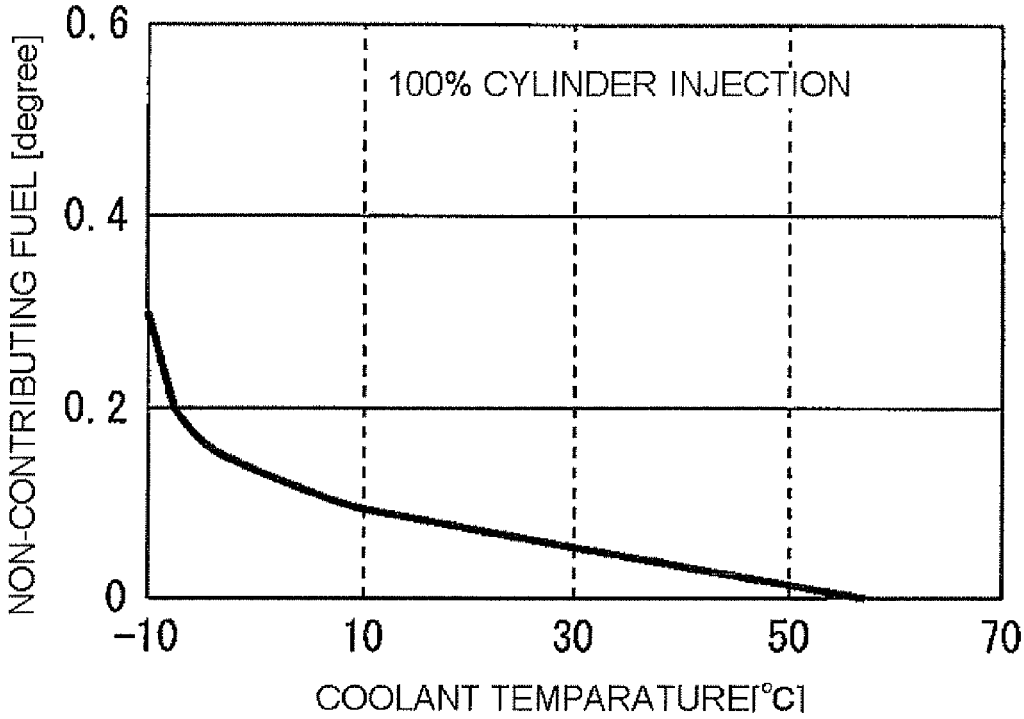
FIG. 5 is the second map of the present invention.
Figure 6:
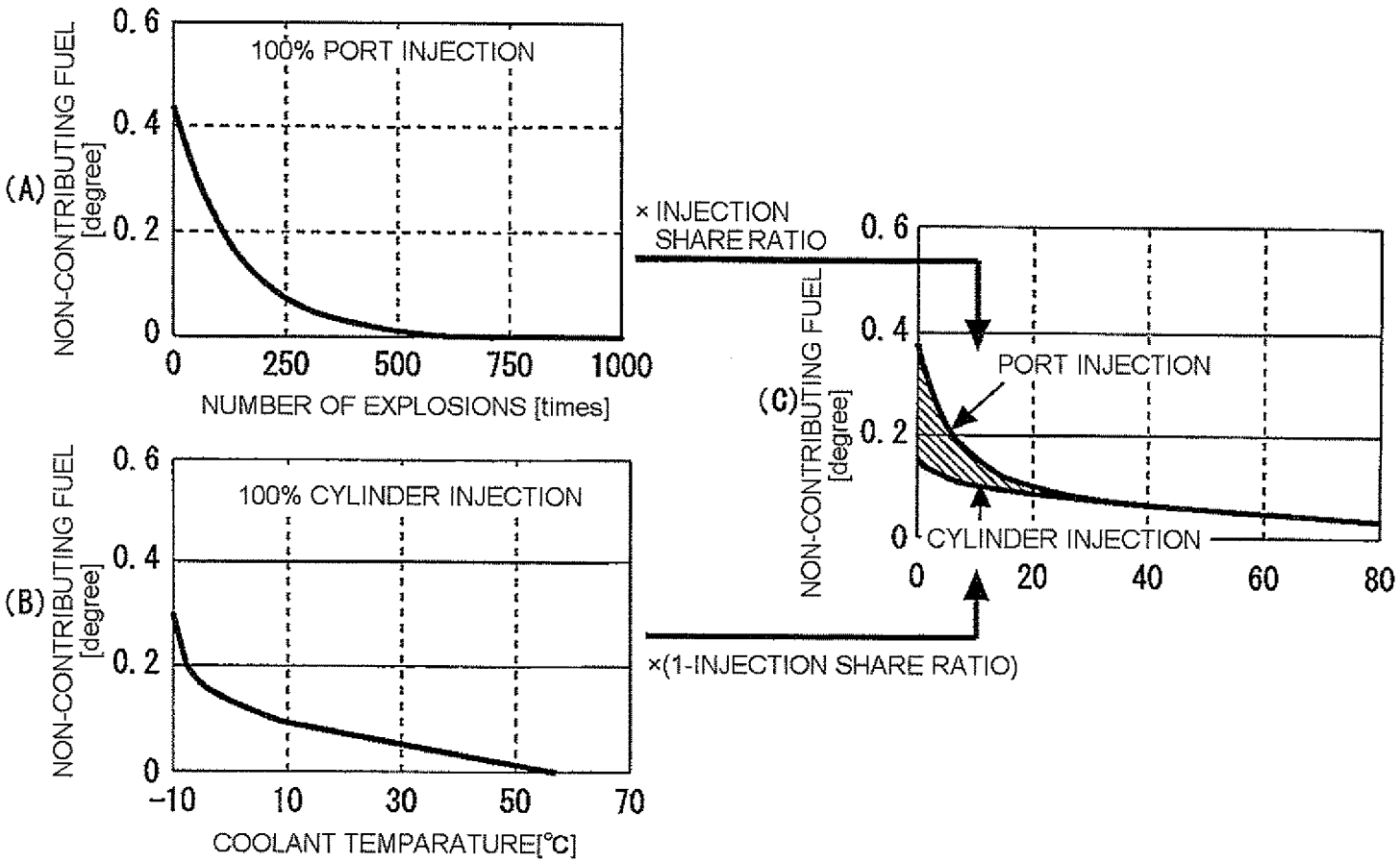
FIG. 6 shows schematically specific methods for calculating the non-contributing fuel requirement value.

From the foregoing, the relation between the coolant temperature of the internal combustion engine and the non-contributing fuel for 100% cylinder injection can be represented by a characteristic curve shown in FIG. 5. This is for the following reason. Specifically, whether the fuel deposited in the cylinder turns to the non-contributing fuel is correlated with a temperature of a cylinder inner wall and the temperature of the cylinder inner wall can be represented as the coolant temperature+$\alpha$. The coolant temperature and the non-contributing fuel are correlated with each other and thus can be represented by one characteristic curve, regardless of the operating condition of the internal combustion engine. In the present invention, the characteristic curve of FIG. 5 is defined as the second map.

(Calculation of the Non-contributing Fuel Requirement Value)

A specific method for calculating the non-contributing fuel requirement value in the non-contributing fuel calculating section 30 will be described below. The non-contributing fuel calculating section 30 calculates the non-contributing fuel requirement value for a case in which port injection and cylinder injection are performed simultaneously by applying the above-described first and second maps to the number of explosions and the coolant temperature (expression (1)).

Non-contributing fuel requirement value=(non-contributing fuel for 100% port injection×injection share ratio)+(non-contributing fuel for 100% cylinder injection×(1−injection share ratio)) (Expression 1)

Specifically, if the number of explosions and the coolant temperature during any cycle can be acquired, these can be applied to the first and second maps, respectively, to thereby find the non-contributing fuel for 100% port injection and the non-contributing fuel for 100% cylinder injection. Then, following the expression (1) above, each of these values of the non-contributing fuel is multiplied by a corresponding injection share ratio to thereby find non-contributing fuel that takes into account the injection share ratio. Finally, these values are added up to arrive at the non-contributing fuel requirement value.

As described above, the non-contributing fuel calculating section 30 calculates the non-contributing fuel requirement value using the expression (1) above according to the applicable injection share ratio. The non-contributing fuel requirement value can therefore be calculated easily and highly accurately even if the injection share ratios of the fuel injection gradually changes.

FIGS. 6(A), 6(B), and 6(C) show schematically specific methods for calculating the non-contributing fuel requirement value. As described above, the non-contributing fuel calculating section 30 stores the first map (FIG. 6(A)) and the second map (FIG. 6(B)). Output values from the crank angle sensor 14 and the coolant temperature sensor 16 are input to the non-contributing fuel calculating section 30. The number of explosions and the coolant temperature during any cycle can therefore be acquired, so that the non-contributing fuel by port injection and the non-contributing fuel by cylinder injection can be found, respectively. By multiplying each of the non-contributing fuel values by the injection share ratio, a non-contributing fuel value that takes the injection share ratio into account can be found (FIG. 6(C)).

In the embodiment described heretofore, the non-contributing fuel requirement value can be calculated according to the injection share ratio using the expression (1) given above. If the non-contributing fuel requirement value can be calculated, port injection and cylinder injection can be performed with a correction for the non-contributing fuel incorporated into the fuel quantity requirement. This favorably inhibits a situation in which the exhaust air-fuel ratio is fuel-leaner than the target air-fuel ratio.

Additionally, in this embodiment, the non-contributing fuel requirement value and the fuel quantity requirement can be calculated separately from each other. If the non-contributing fuel requirement value is not isolated from the fuel quantity requirement, the non-contributing fuel requirement value needs to be readapted each time the fuel quantity requirement changes. In this respect, this embodiment allows the non-contributing fuel requirement value to be calculated even if the fuel quantity requirement is changed to respond to a change in the target air quantity or the target air-fuel ratio, thus eliminating the need for readaptation. A correction for the non-contributing fuel can therefore be easily incorporated in the fuel quantity requirement.

In the embodiment described above, when the non-contributing fuel requirement value is to be obtained, the number of explosions and the coolant temperature are applied to the first map and the second map, respectively, to thereby find respective non-contributing fuel values before the values being multiplied by the respective injection share ratios. However, the first and second maps are prepared based on the number of explosions and the coolant temperature, respectively, which represent parameters associated with temperature. For this reason, the non-contributing fuel requirement value can be found by applying a predetermined parameter common to the number of explosions and the coolant temperature to a single characteristic map.

Specifically, a plurality of characteristic maps prepared for respective injection share ratios is stored in advance in the ECU 20. Each of these characteristic maps defines a relation between a predetermined parameter common to the number of explosions and the coolant temperature, and the non-contributing fuel.

A method for calculating the non-contributing fuel requirement value when these characteristic maps are stored in the ECU 20 is as follows. First, a predetermined parameter during any cycle and an injection share ratio are acquired. Given the injection share ratio, a specific characteristic map can be identified from among those characteristic maps. Applying the predetermined parameter to the characteristic map identified allows a ratio of the non-contributing fuel to be obtained. Consequently, having a plurality of characteristic maps prepared for respective injection share ratios stored in the ECU 20 allows the non-contributing fuel requirement value to be obtained without having to resort to the method of the embodiment described above. Specifically, the non-contributing fuel requirement value can be found without having to apply the number of explosions and the coolant temperature to the first and second maps and further to go through multiplication by the injection share ratios.

Figure 7:
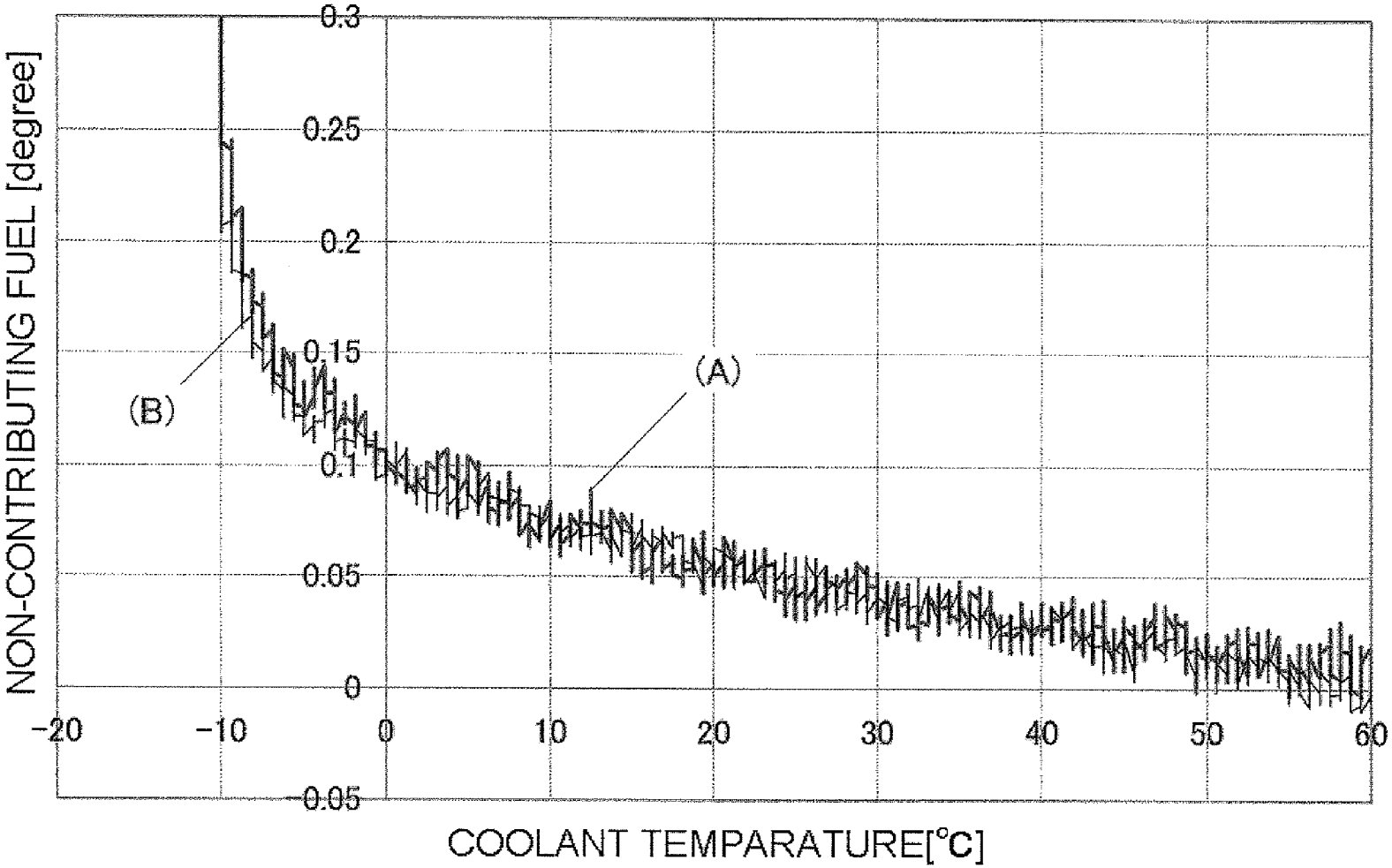
FIG. 7 is a graph showing relations between the coolant temperature [° C.] and the non-contributing fuel [degree] when port injection and cylinder injection are simultaneously performed.
Figure 8:
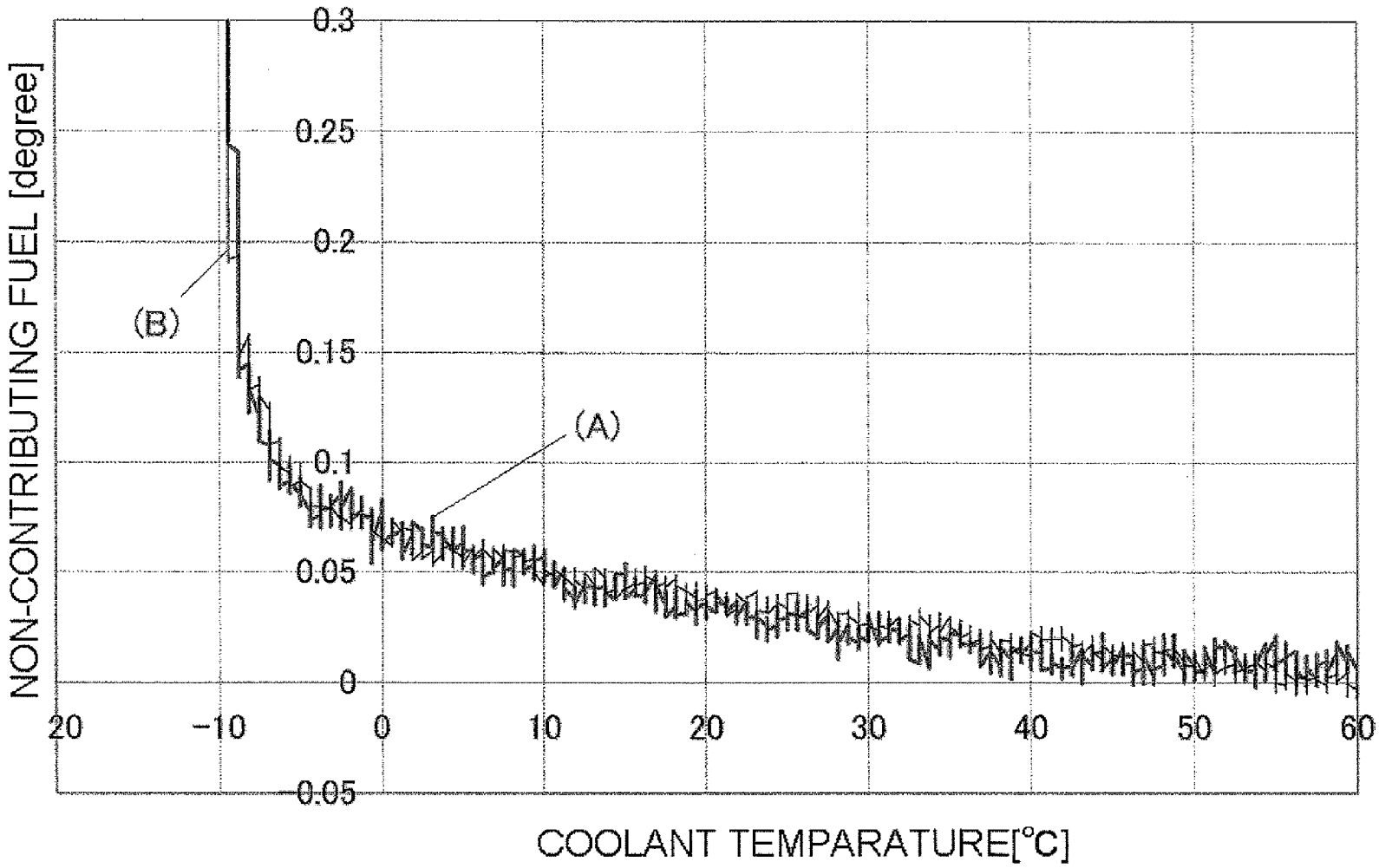
FIG. 8 is a graph showing relations between the coolant temperature [° C.] and the non-contributing fuel [degree] when port injection and cylinder injection are simultaneously performed.

A case in which the coolant temperature is used as the above-mentioned predetermined parameter will be described below with reference to FIGS. 7 and 8. FIGS. 7 and 8 are graphs showing relations between the coolant temperature [° C.] and the non-contributing fuel [degree] when port injection and cylinder injection are simultaneously performed. FIG. 7 shows the relation for an injection share ratio of 0.25 and FIG. 8 shows the relation for an injection share ratio of 0.5. In FIGS. 7 and 8, actual measurements (FIG. 7(A) and FIG. 8(A)) are compared with calculation results (FIG. 7(B) and FIG. 8(B)).

As shown in FIGS. 7 and 8, the actual measurements (FIG. 7(A) and FIG. 8(A)) are substantially equivalent to the calculation results (FIG. 7(B) and FIG. 8(B)). From the foregoing, the non-contributing fuel requirement value can be quickly found by having a map that defines the relation between the coolant temperature and the non-contributing fuel prepared for each injection share ratio.

The invention claimed is:

1. A fuel injection device for an internal combustion engine comprising:

a port injector for injecting fuel into an intake port of the internal combustion engine;

a cylinder injector for directly injecting fuel into a cylinder of the internal combustion engine;

fuel injection quantity calculating means for calculating, for each cycle, a fuel injection quantity required for achieving a target air-fuel ratio;

fuel injection share ratio setting means for setting, for each cycle, an injection share ratio of fuel to be shared between the port injector and the cylinder injector;

parameter acquiring means for acquiring a predetermined parameter associated with a temperature of the internal combustion engine;

a model for associating a ratio of non-contributing fuel, of fuel injected during one cycle, not contributing to combustion with a predetermined parameter associated with the temperature of the internal combustion engine and the injection share ratio of fuel to be shared between the port injector and the cylinder injector; and non-contributing fuel quantity calculating means for calculating a quantity of the non-contributing fuel by using the calculated fuel injection quantity and the ratio of non-contributing fuel which is calculated by applying the set injection share ratio and the acquired predetermined parameter to the model.

2. The fuel injection device for an internal combustion engine according to claim 1, wherein:

the model comprises:

a first map for establishing, when fuel is injected only from the port injector, a relation between a ratio of non-contributing fuel, of fuel injected during one cycle, not contributing to combustion and a first parameter associated with the temperature of the internal combustion engine; and a second map for establishing, when fuel is injected only from the cylinder injector, a relation between a ratio of non-contributing fuel, of fuel injected during one cycle, not contributing to combustion and a second parameter associated with the temperature of the internal combustion engine;

non-contributing fuel quantity calculating means comprises:

first non-contributing ratio calculating means for calculating a first non-contributing ratio as a ratio of non-contributing fuel injected from the port injector by applying the acquired first parameter to the first map to thereby calculate a ratio of non-contributing fuel, and multiplying the ratio of non-contributing fuel thus calculated by the injection share ratio;

second non-contributing ratio calculating means for calculating a second non-contributing ratio as a ratio of non-contributing fuel injected from the cylinder injector by applying the acquired second parameter to the second map to thereby calculate a ratio of non-contributing fuel, and multiplying the ratio of non-contributing fuel thus calculated by (1−the injection share ratio); and non-contributing ratio adding means for adding the first non-contributing ratio and the second non-contributing ratio.

3. The fuel injection device for an internal combustion engine according to claim 2, wherein:

the first parameter used for the first map includes an explosion count of the internal combustion engine.

4. The fuel injection device for an internal combustion engine according to claim 2, wherein:

the second parameter used for the second map includes a coolant temperature of the internal combustion engine.

5. A fuel injection device for an internal combustion engine comprising:

a port injector for injecting fuel into an intake port of the internal combustion engine;

a cylinder injector for directly injecting fuel into a cylinder of the internal combustion engine;

a fuel injection quantity calculating unit for calculating, for each cycle, a fuel injection quantity required for achieving a target air-fuel ratio;

a fuel injection share ratio setting unit for setting, for each cycle, an injection share ratio of fuel to be shared between the port injector and the cylinder injector;

a parameter acquiring unit for acquiring a predetermined parameter associated with a temperature of the internal combustion engine;

a model for associating a ratio of non-contributing fuel, of fuel injected during one cycle, not contributing to combustion with a predetermined parameter associated with the temperature of the internal combustion engine and the injection share ratio of fuel to be shared between the port injector and the cylinder injector; and a non-contributing fuel quantity calculating unit for calculating a quantity of the non-contributing fuel by using the calculated fuel injection quantity and the ratio of non-contributing fuel which is calculated by applying the set injection share ratio and the acquired predetermined parameter to the model.

6. The fuel injection device for an internal combustion engine according to claim 5, wherein:

the model comprises:

a first map for establishing, when fuel is injected only from the port injector, a relation between a ratio of non-contributing fuel, of fuel injected during one cycle, not contributing to combustion and a first parameter associated with the temperature of the internal combustion engine; and a second map for establishing, when fuel is injected only from the cylinder injector, a relation between a ratio of non-contributing fuel, of fuel injected during one cycle, not contributing to combustion and a second parameter associated with the temperature of the internal combustion engine;

the non-contributing fuel quantity calculating unit comprises:

a first non-contributing ratio calculating unit for calculating a first non-contributing ratio as a ratio of non-contributing fuel injected from the port injector by applying the acquired first parameter to the first map to thereby calculate a ratio of non-contributing fuel, and multiplying the ratio of non-contributing fuel thus calculated by the injection share ratio;

a second non-contributing ratio calculating unit for calculating a second non-contributing ratio as a ratio of non-contributing fuel injected from the cylinder injector by applying the acquired second parameter to the second map to thereby calculate a ratio of non-contributing fuel, and multiplying the ratio of non-contributing fuel thus calculated by (1−the injection share ratio); and a non-contributing ratio adding unit for adding the first non-contributing ratio and the second non-contributing ratio.

7. The fuel injection device for an internal combustion engine according to claim 6, wherein:

the first parameter used for the first map includes an explosion count of the internal combustion engine.

8. The fuel injection device for an internal combustion engine according to claim 6, wherein:

the second parameter used for the second map includes a coolant temperature of the internal combustion engine.

* * * * *